US010765266B2

(12) United States Patent
Stout

(10) Patent No.: US 10,765,266 B2
(45) Date of Patent: Sep. 8, 2020

(54) HEATED FOG BATHING SYSTEM AND METHOD OF CONTROLLING SAME

(71) Applicant: Kohler Co., Kohler, WI (US)

(72) Inventor: Kenneth L. Stout, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/237,182

(22) Filed: Dec. 31, 2018

(65) Prior Publication Data

US 2019/0254485 A1 Aug. 22, 2019

Related U.S. Application Data

(60) Provisional application No. 62/631,992, filed on Feb. 19, 2018.

(51) Int. Cl.

| | |
|---|---|
| ***A47K 3/10*** | (2006.01) |
| ***A61H 33/00*** | (2006.01) |
| ***A61H 33/02*** | (2006.01) |

(52) U.S. Cl.

CPC ..... *A47K 3/10* (2013.01); *A61H 33/0087* (2013.01); *A61H 33/0095* (2013.01); *A61H 2033/0029* (2013.01); *A61H 2033/021* (2013.01); *A61H 2033/022* (2013.01); *A61H 2201/0207* (2013.01); *A61H 2201/5002* (2013.01); *A61H 2201/5082* (2013.01)

(58) Field of Classification Search

CPC ..... A47K 3/10

USPC ..... 4/541

See application file for complete search history.

(56) References Cited

U.S. PATENT DOCUMENTS

| | | | | |
|---|---|---|---|---|
| 520,880 | A | 6/1894 | Gwynn, Jr. et al. | |
| 1,495,644 | A * | 5/1924 | Poussin | E03D 9/031 4/223 |
| 3,207,133 | A | 9/1965 | Andersen | |
| 3,571,818 | A | 3/1971 | Jacuzzi | |
| 4,249,522 | A | 2/1981 | Carrier | |
| 4,333,490 | A | 6/1982 | Enter | |
| 4,833,739 | A | 5/1989 | Sakakibara et al. | |
| 5,842,645 | A * | 12/1998 | Degongre | E03O 1/046 239/312 |
| 5,930,851 | A | 8/1999 | Brunelle | |
| 6,317,903 | B1 | 11/2001 | Brunelle et al. | |
| 7,775,457 | B2 | 8/2010 | Schnuckle | |
| 9,487,350 | B2 | 11/2016 | Sivan | |
| 2008/0072375 | A1 | 3/2008 | Stewart | |

* cited by examiner

*Primary Examiner* — Lori L Baker

(74) *Attorney, Agent, or Firm* — Foley & Lardner LLP

(57) ABSTRACT

A bathing system includes a primary reservoir, a secondary reservoir, and an atomizer. The primary reservoir is configured to hold a first volume of water. The secondary reservoir is in fluid communication with the primary reservoir by a channel. The secondary reservoir is configured to hold a second volume of water. The atomizer is disposed in the secondary reservoir, and is configured to introduce water from the second volume of water into a flow of air received in the channel by atomizing at least a portion of the second volume of water to form an air-water mixture upstream of the primary reservoir.

20 Claims, 6 Drawing Sheets

HEATED FOG BATHING SYSTEM AND METHOD OF CONTROLLING SAME

CROSS-REFERENCE TO RELATED APPLICATIONS

This application claims the benefit of and priority to U.S. Provisional Application No. 62/631,992, filed on Feb. 19, 2018, the entire disclosure of which is hereby incorporated by reference herein.

BACKGROUND

The present disclosure relates generally to the field of bathing systems (e.g., bathtubs, bubble massaging or hydro-massaging bath systems, whirlpool tubs, etc.). Specifically, this application relates to a bathing system that can generate heated bubbles to provide a bubble massage.

SUMMARY

At least one embodiment of the present disclosure relates to a bathing system including a primary reservoir, a secondary reservoir, and an atomizer. The primary reservoir is configured to hold a first volume of water. The secondary reservoir is in fluid communication with the primary reservoir by a channel. The secondary reservoir is configured to hold a second volume of water. The atomizer is disposed in the secondary reservoir, and is configured to introduce water from the second volume of water into a flow of air received in the channel by atomizing at least a portion of the second volume of water to form an air-water mixture upstream of the primary reservoir.

Another embodiment relates to a bathing system including a primary reservoir, a secondary reservoir, an atomizer, a fluid conduit, and an air blower. The primary reservoir is configured to hold a first volume of water. The secondary reservoir is in fluid communication with the primary reservoir. The secondary reservoir is configured to hold a second volume of water. The atomizer is disposed in the secondary reservoir. The fluid conduit fluidly couples the secondary reservoir to the primary reservoir. The air blower is in fluid communication with the fluid conduit, and is configured to provide a flow of air to the fluid conduit. The atomizer is configured to introduce water from the second volume of water into the flow of air by atomizing at least a portion of the second volume of water to form an air-water mixture. The fluid conduit is configured to direct the air-water mixture to the primary reservoir to create bubbles in the first volume of water.

Yet another embodiment relates to a method of controlling the water temperature of a bathing system. The method comprises providing a flow of air to a fluid conduit, wherein the fluid conduit is in fluid communication with a primary reservoir including a first volume of water and a secondary reservoir including a second volume of water; introducing water from the second volume of water into the flow of air by atomizing at least a portion of the second volume of water to form an air-water mixture; and directing the air-water mixture to the primary reservoir to create bubbles in the first volume of water.

In some exemplary embodiments, the bathing system further comprises an air blower fluidly coupled to the channel, wherein the air blower is configured to provide the flow of air.

In some exemplary embodiments, the atomizer is coupled to a wall of the secondary reservoir, and is configured to be at least partially submerged in the second volume of water.

In some exemplary embodiments, the atomizer is configured to float within the secondary reservoir, and is configured to be at least partially submerged in the second volume of water.

In some exemplary embodiments, the bathing system further comprises a first heater disposed in the secondary reservoir, wherein the first heater is configured to heat the second volume of water.

In some exemplary embodiments, the bathing system further comprises a second heater configured to heat the air-water mixture upstream of the primary reservoir.

In some exemplary embodiments, the secondary reservoir includes a pitched lower surface configured to facilitate draining of fluid from the secondary reservoir.

In some exemplary embodiments, the bathing system further comprises a controller operatively coupled to the atomizer.

In some exemplary embodiments, the bathing system further comprises a water level sensor disposed in the secondary reservoir, wherein the water level sensor is configured to detect a water level in the secondary reservoir and to send a corresponding electronic signal to the controller to purge the secondary reservoir of fluid.

In some exemplary embodiments, the method further comprises heating at least one of the air-water mixture or the second volume of water prior to directing the air-water mixture to the primary reservoir.

In some exemplary embodiments, the method further comprises receiving, by a controller, an electronic signal indicative of a water level of the secondary reservoir; and purging, in response to the electronic signal, the secondary reservoir of fluid.

DETAILED DESCRIPTION

Figure 1:
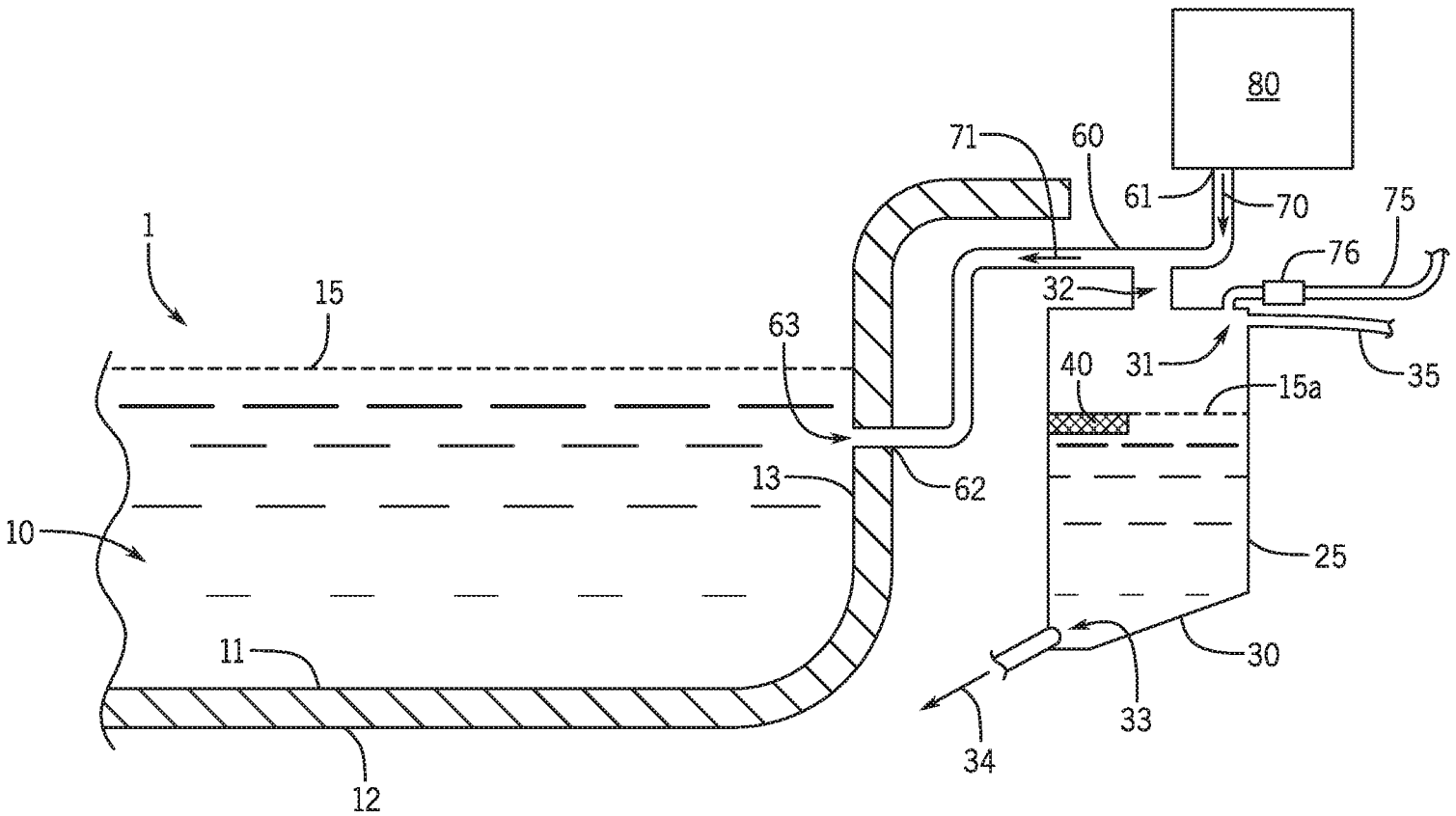
FIG. 1 is a schematic showing a side view of a bathing system, according to an exemplary embodiment.

Conventional bubble massaging or hydro-massaging bath systems typically suffer from relatively rapid cooling rates while a user is taking a bath. For instance, conventional systems cool very quickly; approximately 5 degrees Fahrenheit or more over a period of about 20 minutes. Specifically, conventional bath systems may lose between about 5.6 to about 6 degrees Fahrenheit over a period of about 20 minutes. This rapid cooling is caused by the introduction of cool, dry air into the system to form bubbles, particularly in the bathing vessel in which the bather bathes. Some conventional bathing systems require an additional water line to inject a spray of water into the air conduits leading to the tub, which are subsequently heated to compensate for the temperature loss. Because the spray of water is not broken down into sufficiently small particles or droplets, however, the water spray in the extra water line is generally ineffective at increasing the humidity of air in the air conduits, so cool, dry air continues to be introduced into the system. Accordingly, this approach is not effective at maintaining a bath water temperature in a bubble massage bathing system over a period of about 20 minutes or more.

There is, therefore, a need for a bubble massaging bath system that can maintain a temperature of a volume of water in the bathing system to a predetermined temperature to provide a more comfortable bathing experience for a user.

Referring generally to the figures, disclosed herein are heated bubble massage bathing systems and methods. These systems are designed to maintain a temperature and a humidity in a bubble massage bath for periods of time of at least about 20 minutes. Specifically, these systems are designed to achieve a loss of not more than about 3.5 degrees Fahrenheit over a period of about 20 minutes. These systems include a primary reservoir (e.g., a bathtub, etc.) configured to hold a first volume of water for bathing in, and a secondary reservoir configured to hold a second volume of water and at least one atomizer disposed in the secondary reservoir. The primary and secondary reservoirs are in fluid communication with each other. The at least one atomizer is configured to produce atomized water in the secondary reservoir, which is introduced into a flow air to form an air-water mixture. The air-water mixture is directed to the primary reservoir to form bubbles in the first volume of water, thereby providing a bubble massage. The water in the secondary reservoir may be heated and/or the air-water mixture itself may be heated prior to entering the primary reservoir. In this manner, an appropriate relative humidity of the air in contact with the first volume of water held in the primary reservoir can be achieved. Additionally, by heating the atomized water and/or the air-water mixture, a desired water temperature can be maintained in the first volume of water in the primary reservoir, consistent with a comfortable bathing experience for a user.

Figure 2:
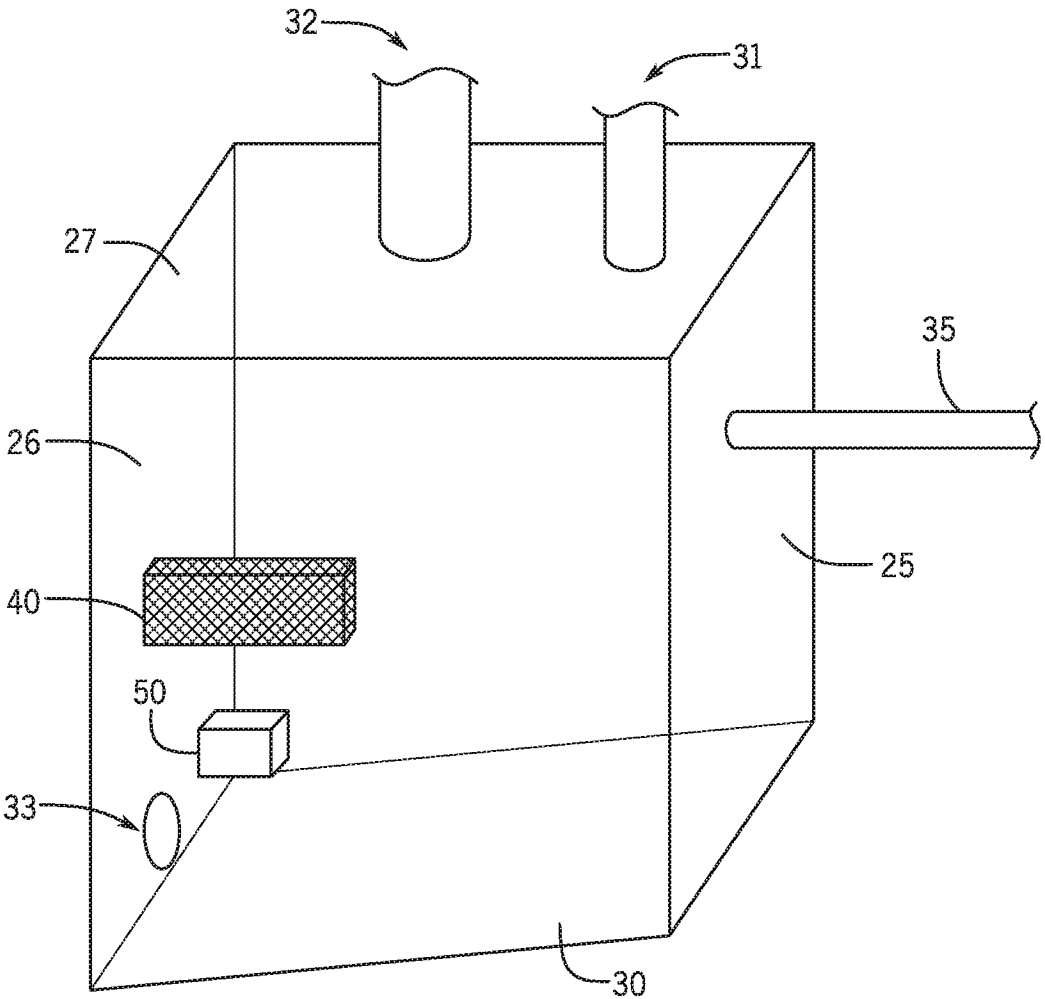
FIG. 2 is a perspective view of a secondary reservoir of the bathing system of FIG. 1.
Figure 3:
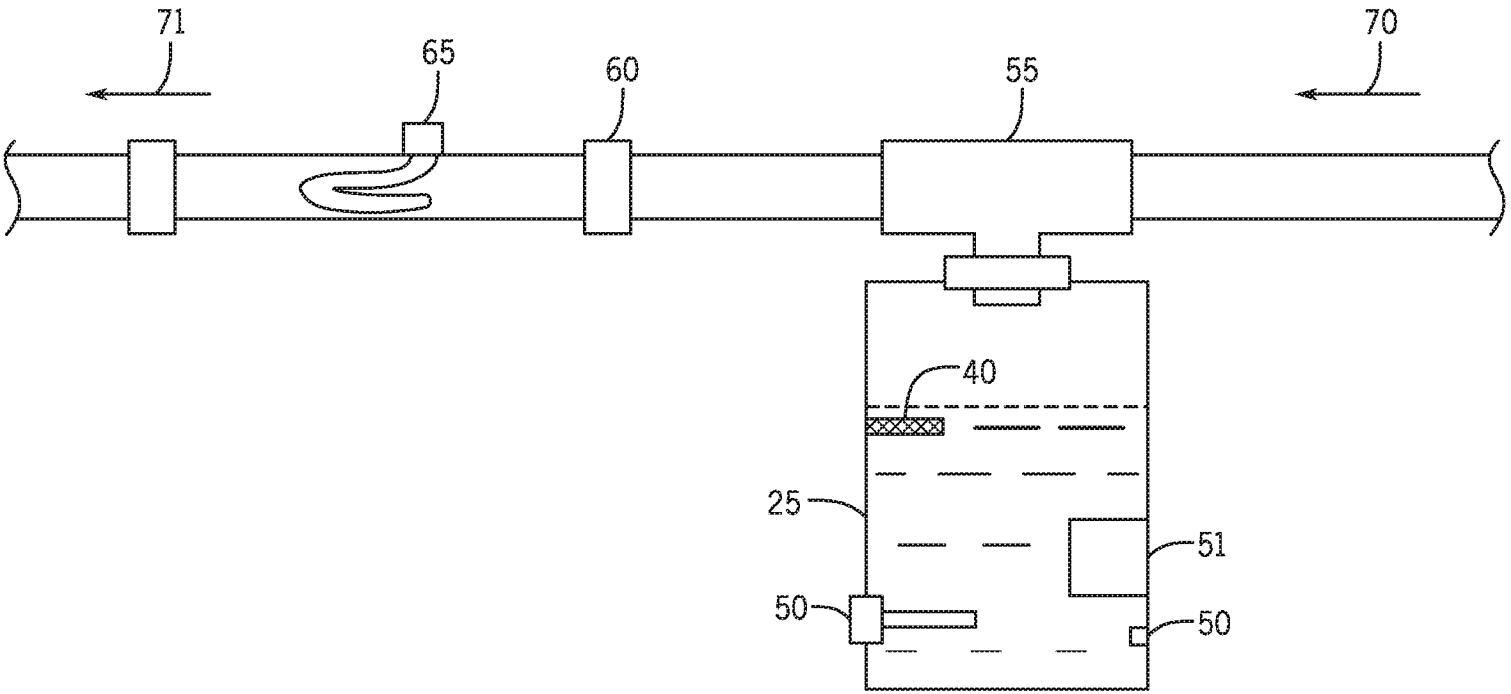
FIG. 3 is a schematic showing a side view of various components of the bathing system of FIG. 1.

Referring generally to FIGS. 1-3, a bathing system 1 (e.g., a bubble massage bathing system, a hydro-massage bathing system, etc.) is shown by way of example to include a primary reservoir 10 and a secondary reservoir 25. The bathing system 1 also includes at least one atomizer 40 disposed within the secondary reservoir 25. The bathing system 1 also includes an air blower 80 in fluid communication with a channel 60 (e.g., fluid conduit, etc.), which fluidly couples a first fluid outlet 32 of the secondary reservoir 25 with the primary reservoir 10 via an opening 63 (e.g., jet orifice, etc.). The opening 63 is configured to create bubbles in the water contained in the primary reservoir 10 to provide a bubble massage for a user. According to an exemplary embodiment, the primary reservoir 10 includes a plurality of openings 63.

According to the exemplary embodiment of FIG. 1, the primary reservoir 10 (e.g., a bathtub, massage tub, bathing vessel, etc.) is configured to hold a first volume of water. The first volume of water forms a water line 15 within the primary reservoir 10. The first volume of water held by the primary reservoir 10 is determined by a user, for example, or determined automatically by a control system (such as controller 90 shown in FIG. 4), as another example. By controlling the amount of the first volume of water held in the primary reservoir 10, the water line 15 is adjusted or maintained. According to various exemplary embodiments, the primary reservoir 10 can be of any suitable size or shape. For example, the primary reservoir 10 is of a same size and/or shape as a conventional bubble massage bathtub, as shown in the embodiment of FIG. 1. The primary reservoir 10 is defined by a vessel wall 13 having an inner surface 11 and an outer surface 12.

Referring to FIGS. 1-2, the bathing system 1 also includes the secondary reservoir 25. The secondary reservoir 25 is configured to hold a second volume of water. The secondary reservoir 25 in combination with a flow of air received in the channel 60 are configured to provide air bubbles to the first volume of water held in the primary reservoir 10 (as described in more detail below). As shown in FIG. 2, according to one aspect, the secondary reservoir 25 includes a top surface 27, at least one side surface 26, and a pitched lower surface 30. The secondary reservoir includes a fluid inlet 31 disposed at the top surface 27 of the secondary reservoir 25. The fluid inlet 31 is fluidly coupled to a fluid conduit 75 (e.g., channel, etc.), which is fluidly coupled to an external water source (not shown), such as a household water source. A flow of water to the fluid inlet 31 from pipe 75 is controlled by water valve 76 shown in FIG. 1, which is configured to control the water level 15*a* in the secondary reservoir 25. The secondary reservoir 25 also includes a first fluid outlet 32 disposed at the top surface 27 of the secondary reservoir 25, and a second fluid outlet 33 disposed on a bottom portion of the pitched lower surface 30.

Referring to FIG. 1, the pitched lower surface 30 of the secondary reservoir 25 is configured to facilitate drainage (e.g., purging) of fluid (e.g., water, air-water mixture, etc.) from the secondary reservoir 25. For example, when a user has completed a bath, the second volume of water in the secondary reservoir 25 must be purged, for example, by draining the second volume of water through the second fluid outlet 33 and providing a drainage flow 34 to a drain (not shown). As a specific example, the pitched lower surface 30 is configured to allow the second volume of water in the secondary reservoir 25 to drain into a household drain. The secondary reservoir 25 also includes an overflow pipe or channel 35, which is configured to allow an excess volume of water held in the secondary reservoir 25 to flow out of the secondary reservoir 25 through the overflow conduit or channel 35 to a fluid outlet (not shown). In this manner, standing water that may be present in the secondary reservoir 25 can be reduced or eliminated when the bathing system 1 is not in use.

According to one aspect, the secondary reservoir 25 also includes at least one water level sensor 50 disposed at a suitable location on an inner wall (such as the side surface 26 shown in FIG. 2) of the secondary reservoir 25. For example, a water level sensor 50 is disposed at a first location on the at least one side surface 26 of the secondary reservoir 25 and a second water level sensor 50 is disposed at another location on either the same side surface 26 or a different side surface or a bottom surface 30 of the secondary reservoir 25. The at least one water level sensor 50 is configured to detect a level of water (e.g., water level 15*a*) present in the secondary reservoir 25. When the at least one water level sensor 50 detects a water level below a predetermined threshold (for example, when a user drains water from the reservoir or bathtub), the at least one water level sensor 50 sends an electronic signal to a controller 90 (shown in FIG. 4) that controls a purging of any residual water in the secondary reservoir 25. The at least one water level sensor 50 is disposed in the reservoir 25 to avoid limiting or ruining the aesthetic appearance of the bathing system 1.

According to one aspect, the secondary reservoir 25 includes at least one heater 51 configured to heat the second volume of water held within the secondary reservoir 25, as shown in FIG. 3. The at least one heater 51 is configured to heat the second volume of water before any portion of the second volume of water is drawn into the at least one atomizer 40 (described below). For example, the heater 51 is configured to heat the second volume of water from an ambient temperature (e.g., room temperature) to a predetermined temperature, for example, a temperature of about 100 degrees Fahrenheit. After the heated water is atomized by the at least one atomizer 40 (as described below), the heated atomized water is provided to the primary reservoir 10, thereby maintaining and/or increasing a temperature of the first volume of water held within the primary reservoir 10.

Referring to FIGS. 1-3, the at least one atomizer 40 is disposed within the secondary reservoir 25. For example, as shown in FIGS. 1-3, the at least one atomizer 40 is physically and/or rigidly mounted to an inner surface of the secondary reservoir 25. Specifically, as shown in FIG. 2, the at least one atomizer is physically coupled to the surface 26 of the reservoir 25. Although as shown in FIG. 3, the at least one atomizer 40 is coupled to the same surface 26 of the reservoir 25 that includes the fluid inlet 31, the present disclosure is not particularly limited to this example. The at least one atomizer 40 may be coupled to any surface of the reservoir 25, for example. The at least one atomizer 40 is configured to create micro-droplets of water. For example, the at least one atomizer 40 is configured to create micro-droplets of water of a size of less than about 0.5 microns in diameter. According to one aspect, the at least one atomizer 40 includes a piezoelectric transducer with a resonating frequency of approximately 1.6 MHz, as one example. The at least one atomizer 40 produces and/or focuses ultrasonic waves on the second volume of water held by the secondary reservoir 25 to produce a fog that comprises the micro-droplets of water. Rapid vibration at ultrasonic speeds produced by the at least one atomizer 40 causes the micro-droplets of water to form. The fog produced by the at least one atomizer 40, including micro-droplets of water, is delivered from the secondary reservoir 25 via the first fluid outlet 32 to the primary reservoir 10 through a channel 60 (described below). By continuously delivering the fog including the micro-droplets of water, the fog increases and/or maintains a humidity level of ambient air that is in contact with the first volume of water held within the primary reservoir 10.

In some aspects, increasing the number of the at least one atomizer 40 in the secondary reservoir 25 will allow further increases in the humidity of the air in contact with the first volume of water held in the primary reservoir 10, because an amount of the fog including the micro-droplets of water provided to the primary reservoir 10 increases the humidity of the air. In some aspects, the at least one atomizer 40 is automatically controlled by the controller 90 (shown in FIG. 4). In other aspects, the at least one atomizer 40 is manually controlled by a user. In some aspects, when the at least one atomizer 40 includes a plurality of atomizers, the plurality of atomizers in the secondary reservoir 25 are configured to be independently controlled, that is, each individual atomizer is controlled independently of the other atomizers such that a desired amount of fog including micro-droplets of water is provided to the primary reservoir 10, thereby maintaining a desired relative humidity of the air.

To operate effectively, the at least one atomizer 40 must be at least partially submerged (e.g., almost completely submerged, etc.) in the volume of water held within the secondary reservoir 25. For example, the optimal operating depth for the atomizer 40 is between about 1 inch and about 4 inches, such that the entire atomizer is disposed at least about 1 inch below the water level 15 in the secondary reservoir 25. A sensor (not shown) in each of the at least one atomizer 40 detects a level of water in the secondary reservoir 25 and activates the transducer in the at least one atomizer 40 when a suitable level of water in the secondary reservoir 25 is achieved, for example, by using a float switch. The use of the at least one atomizer 40, advantageously, eliminates a need for heating or boiling of the second volume of water held in the secondary reservoir 25 before fogging. Heating or boiling of the second volume of water in the secondary reservoir 25 may be undesirable.

Referring again to FIGS. 1 and 3, the fog produced by the at least one atomizer 40 is delivered to a channel 60 (e.g., pipe) via the first fluid outlet 32 of the secondary reservoir 25. The channel 60 is configured to mix the fog with an airflow 70 produced by an air blower 80, shown in FIG. 1. The channel 60 includes a first end 61 in fluid connection with the air blower 80 and further configured to receive the airflow 70 from the air blower 80. The channel 60 also includes a second end 62 that includes an opening 63 configured to deliver an air-water flow 71 to the primary reservoir 10. Although the opening 63 as shown in FIG. 1 is below the water line 15, the opening 63 is not particularly limited to that orientation or position. For example, the opening 63, in one example, is above water line 15. The fog increases a humidity of the airflow 70, producing an air-water mixture in the air-water flow 71. The air-water mixture is thereby introduced into the first volume of water held in the primary reservoir 10. The air-water mixture is configured to produce bubbles in the first volume of water held in the primary reservoir 10.

According to one aspect, as shown in FIG. 2, the channel 60 optionally includes a heater 65 disposed in the channel 60. In this example, the air-water mixture is heated by heater 65 in the channel 60 prior to introducing the air-water mixture to the primary reservoir 10. Alternatively, the channel 60 is heated by an external heater (not shown) and thereby heats the air-water mixture within the channel 60. The air-water mixture is heated to a predetermined temperature such that the air-water mixture produces heated bubbles when the heated air-water mixture is introduced into the primary reservoir 10.

Referring again to FIG. 3, the system 1 also includes a connector 55 (e.g., a T-connector, a Y-connector, etc.) that couples the secondary reservoir 25 with the channel 60. The connector 55 fluidly couples the first fluid outlet 32 of the secondary reservoir 25 to the channel 60. The connector 55 is configured to allow a fog generated by the at least one atomizer 40 in the secondary reservoir 25 to flow into the airflow 70 produced by an air blower 80 (shown in FIG. 1), thereby creating the air-water flow 71. The airflow 70 and the air-water flow 71 can flow through channel 60 to the opening 63 of the primary reservoir 10. Accordingly, humidity is added to the airflow 70. When the air-water flow 71 (including micro-droplets of water) is delivered to the primary reservoir 10 and/or the ambient air, a humidity of the ambient air surrounding and/or in contact with the first volume of water held in the primary reservoir 10 is maintained or increased. Additionally, because the air-water flow 71 includes micro-droplets of water (which may be heated by a heater, for example the heater 65), a temperature of the first volume of water held in primary reservoir 10 is maintained or increased. For aesthetic purposes, according to one aspect, the channel 60 is hidden from view of a user in the primary reservoir 10. According to one aspect, the connector 55 includes a venturi tube configured to create a vacuum to pull the fog from the secondary reservoir 25 via the first fluid outlet 32 and into the channel 60.

The air-water mixture in the connector 55 flows through the channel 60 and may be heated by the air heater 65 disposed within the channel 60 and located at a suitable location within channel 60. The air heater 65 is disposed at any suitable location within the channel 60 downstream of the first fluid outlet 32 of the secondary reservoir 25. The air heater 65 is configured to heat the air-water mixture to a suitable temperature. According to one aspect, the suitable temperature is a predetermined temperature sufficiently high to maintain a temperature of the bath water to a comfortable temperature for the user. The suitable temperature is, however, low enough to avoid overheating a user in the bath. The heated air-water mixture is then introduced to the primary reservoir 10 (e.g., a bathtub) such that the heated air-water mixture generates bubbles to create a bubble massage bath.

Figure 4:
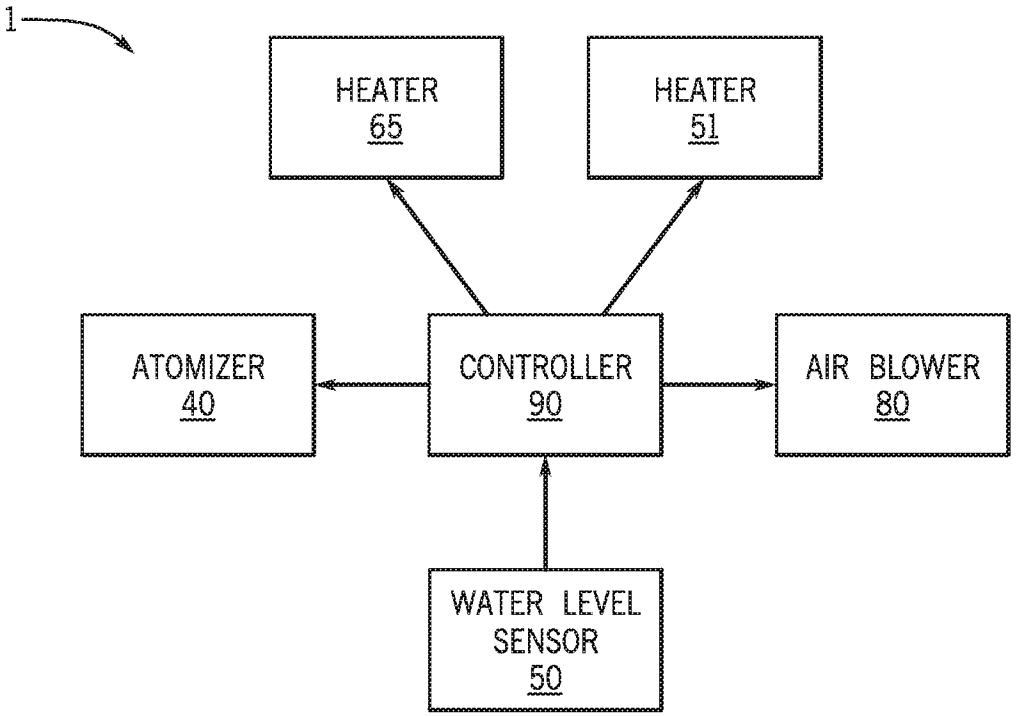
FIG. 4 is a control diagram showing a control system of the bathing system of FIG. 1.

The air heater 65 is controlled by any suitable means. For example, the air heater 65 is controlled manually by a user in a bathtub. A user may manually select a temperature at which the air heater heats the air-water mixture. As a further example, the air heater 65 is controlled automatically such that the air heater 65 heats the air-water mixture to a predetermined temperature and is controlled by controller 90, as shown in FIG. 4.

According to some aspects, the bathing system 1 includes a controller 90. The controller 90 is configured to receive electronic signals from the at least one water level sensor 50 disposed within the secondary reservoir 25. The controller 90 is further configured to control the at least one atomizer 40 disposed within the secondary reservoir 25. For example, the controller 90 controls when the at least one atomizer 40 is turned on and off. As a further example, the controller 90 controls the resonating frequency of the transducer of the at least one atomizer 40. In the case in which the at least one atomizer 40 includes a plurality of atomizers, the controller 90 is configured to independently control the plurality of atomizers; for example, by turning one atomizer on and another atomizer off. The controller 90 is further configured to control either or both of the heater 65 in the channel 60 or the heater 51 in the secondary reservoir 25. Additionally, the controller 90 is configured to control the air blower 80 by, for example, controlling a speed of the air blower 80 or otherwise controlling the air flow 70. In one example, the controller 90 is configured to control one or all of the at least one atomizer 40, the heater 65, the heater 51, or the air blower 80 automatically. In one example, the controller 90 is configured to control one or all of the at least one atomizer 40, the heater 65, the heater 51, or the air blower 80 using a manual input from a user of the bathing system 1. The controller 90 can automatically control the atomizer 40, the heater 65, the heater 51, or the air blower 80 in response to various inputs, such as an electronic signal from water level sensor 50, temperature sensors, other sensors, or a user input.

For example, when a water level 15 of the volume of water in reservoir 25 falls below a predetermined threshold, the at least one water level sensor 50 sends an electronic signal to the air blower 80 via the controller 90. The air blower 80 then purges the channel 60 of any residual water to prevent any accumulation of excess water within the channel 60 (including in and around air heater 65) when the bathing system 1 is not in use.

Figure 5:
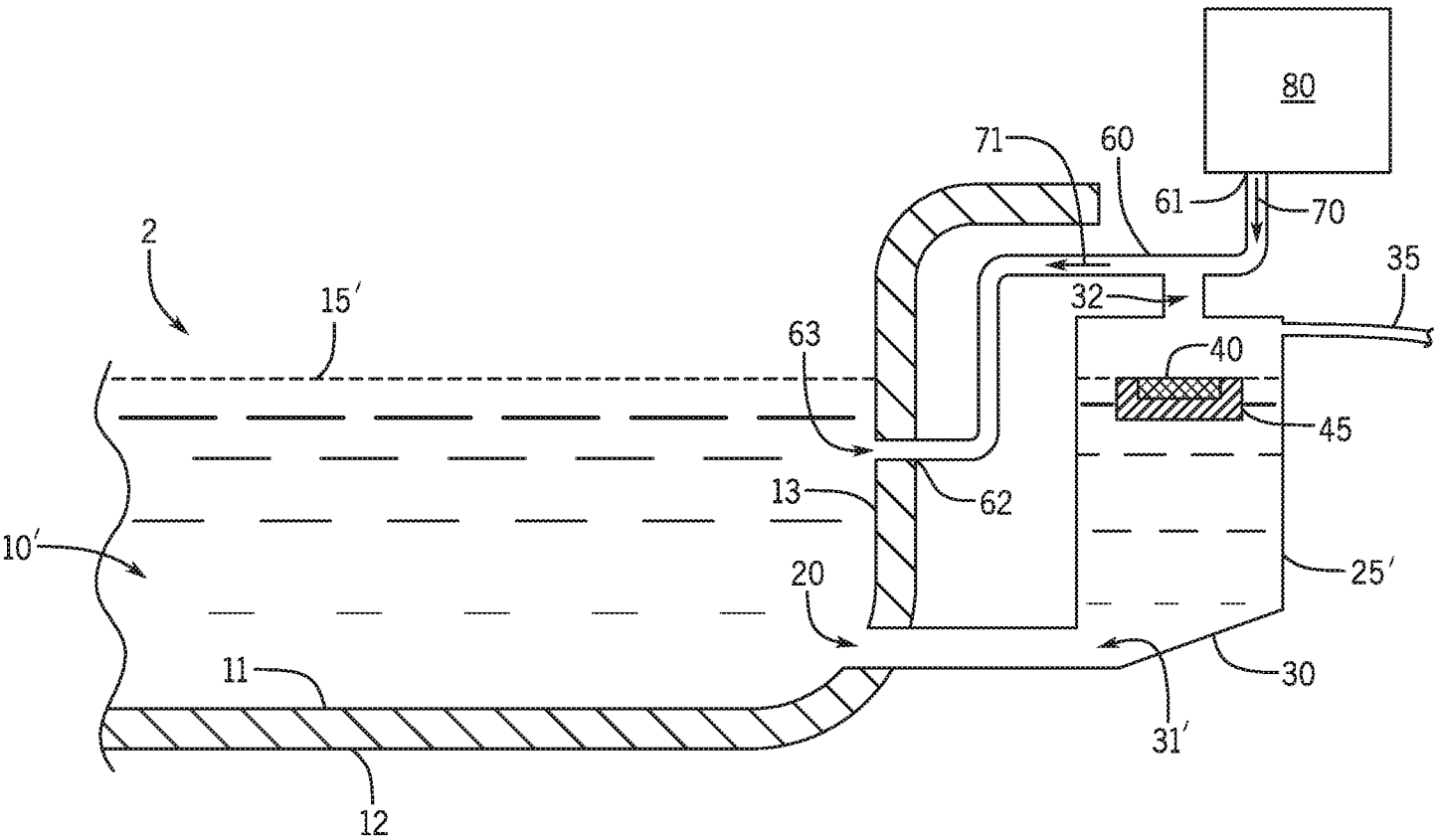
FIG. 5 is a schematic showing a side view of a bathing system, according to another exemplary embodiment.

According to a second exemplary embodiment shown in FIG. 5, a bathing system 2 includes all the features herein described with reference to bathing system 1 except for the differences described below. As shown in FIG. 5, the bathing system 2 includes at least one atomizer 40 disposed on a floater 45 such that the at least one atomizer 40 maintains the appropriate operational position/level relative to the water level 15 in the secondary reservoir 25, as described with reference to the system 1 above. The floater 45 may be made of any sufficiently buoyant materials (e.g., solid or hollow) to provide a floatation platform for the at least one atomizer 40. According to one aspect, the floater 45 may be treated with an anti-microbial agent to minimize growth of bacteria, etc.

Additionally, the bathing system 2 includes a primary reservoir 10', which is similar to the primary reservoir 10 of bathing system 1, except for the differences described below. The primary reservoir 10' is in fluid communication with the secondary reservoir 25' (described in more detail below). Because the primary reservoir 10' and the secondary reservoir 25' are in fluid communication with each other, the water level 15' is the same for both the primary reservoir 10' and the secondary reservoir 25'. Also, the vessel wall 13' of the primary reservoir 10' includes an opening 20 fluidly coupled to a fluid inlet 31' of the secondary reservoir 25, described in more detail below. The opening 20 is configured to provide and/or receive a flow of water to or from the secondary reservoir 25' via the fluid inlet 31' of the secondary reservoir 25'. For example, the opening 20 is configured to provide a flow of water from the primary reservoir 10' such that at least a portion of the first volume of water held in the primary reservoir 10' is transferred to the secondary reservoir 25'. As another example, the opening 20 is configured to receive a flow of water from the secondary reservoir 25' via the fluid inlet 31' such that the secondary reservoir 25' is drained of a second volume of water held in the secondary reservoir.

The secondary reservoir 25' of the bathing system 2 is similar to the secondary reservoir 25 of the bathing system 1, except for the differences described below. The secondary reservoir 25' includes a fluid inlet 31', which is disposed on a lower edge of the pitched lower surface 30 of the secondary reservoir 25'. The fluid inlet 31' is configured to receive a flow of water from the primary reservoir 10' such that at least a portion of the volume of water in the primary reservoir 10' is transferred to the secondary reservoir 25'. The fluid inlet 31' is further configured to be a fluid outlet such that the second volume of water held in the secondary reservoir 25' can be drained from the secondary reservoir 25' due to the pitched lower surface 30 of the secondary reservoir 25'. Additionally, the secondary reservoir 25' of the bathing system 2 is not fluidly coupled to an external water source, unlike the secondary reservoir 25 of the bathing system 1.

Figure 6:
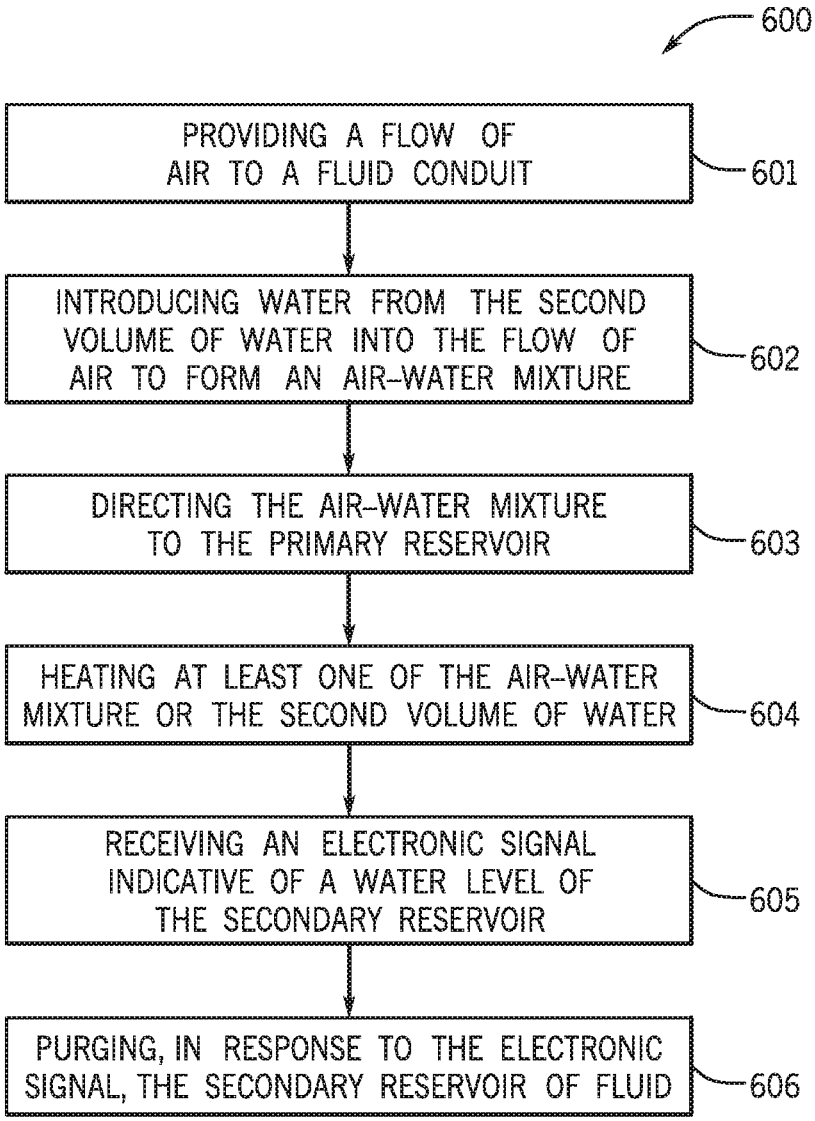
FIG. 6 is a flow chart illustrating a method of controlling the water temperature of a bathing system, according to another exemplary embodiment.

According to an exemplary embodiment of the present disclosure, a method 600 of controlling the water temperature of a bathing system for a heated massage bubble bath is shown in FIG. 6. The method 600 includes a step 601 of providing a flow of air to a fluid conduit, wherein the fluid conduit is in fluid communication with a primary reservoir including a first volume of water and a secondary reservoir including a second volume of water. The method further includes a step 602 of introducing at least a portion of the second volume of water into the flow of air by atomizing at least a portion of the second volume of water to form a mixture of air and water. The method further includes a step 603 of directing the mixture of air and water to the primary reservoir to create bubbles in the first volume of water.

In some exemplary embodiments, the method 600 further includes a step 604 of heating at least one of the mixture of air and water or the second volume of water prior to directing the mixture of air and water to the primary reservoir. In some exemplary embodiments, the method 600 further includes a step 605 of receiving, by a controller, an electronic signal indicative of a water level of the secondary reservoir, and a step 606 of purging the secondary reservoir of fluid in response to the electronic signal.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the bathing system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, any element (e.g., the reservoir, connector, atomizer, heater, etc.) disclosed in one embodiment may be incorporated or utilized with any other embodiment disclosed herein.

What is claimed is:

1. A bathing system comprising:

a primary reservoir configured to hold a first volume of water;

a secondary reservoir in fluid communication with the primary reservoir by a channel, wherein the secondary reservoir is configured to hold a second volume of water;

an atomizer disposed in the secondary reservoir; and an air blower fluidly coupled to the channel, wherein the air blower is configured to provide a flow of air to the channel;

wherein the atomizer is configured to introduce water from the second volume of water into the flow of air received in the channel by atomizing at least a portion of the second volume of water to form an air-water mixture upstream of the primary reservoir.

2. The bathing system of claim 1, wherein the atomizer is coupled to a wall of the secondary reservoir, and wherein the atomizer is configured to be at least partially submerged in the second volume of water.

3. The bathing system of claim 1, wherein the atomizer is configured to float within the secondary reservoir, and wherein the atomizer is configured to be at least partially submerged in the second volume of water.

4. The bathing system of claim 1, further comprising a first heater disposed in the secondary reservoir, wherein the first heater is configured to heat the second volume of water.

5. The bathing system of claim 1, further comprising a second heater configured to heat the air-water mixture upstream of the primary reservoir.

6. The bathing system of claim 1, wherein the secondary reservoir includes a pitched lower surface configured to facilitate draining of fluid from the secondary reservoir.

7. A bathing system comprising:

a primary reservoir configured to hold a first volume of water;

a secondary reservoir in fluid communication with the primary reservoir by a channel, wherein the secondary reservoir is configured to hold a second volume of water;

an atomizer disposed in the secondary reservoir; and a controller operatively coupled to the atomizer;

wherein the atomizer is configured to introduce water from the second volume of water into a flow of air received in the channel by atomizing at least a portion of the second volume of water to form an air-water mixture upstream of the primary reservoir.

8. The bathing system of claim 7, further comprising a water level sensor disposed in the secondary reservoir, wherein the water level sensor is configured to detect a water level in the secondary reservoir and to send a corresponding electronic signal to the controller to purge the secondary reservoir of fluid.

9. The bathing system of claim 7, wherein the atomizer is configured to be at least partially submerged in the second volume of water.

10. The bathing system of claim 7, further comprising a first heater disposed in the secondary reservoir, wherein the first heater is configured to heat the second volume of water.

11. A bathing system comprising:

a primary reservoir configured to hold a first volume of water;

a secondary reservoir in fluid communication with the primary reservoir, wherein the secondary reservoir is configured to hold a second volume of water;

an atomizer disposed in the secondary reservoir;

a fluid conduit fluidly coupling the secondary reservoir to the primary reservoir; and an air blower in fluid communication with the fluid conduit, wherein the air blower is configured to provide a flow of air to the fluid conduit;

wherein the atomizer is configured to introduce water from the second volume of water into the flow of air by atomizing at least a portion of the second volume of water to form an air-water mixture; and wherein the fluid conduit is configured to direct the air-water mixture to the primary reservoir to create bubbles in the first volume of water.

12. The bathing system of claim 11, wherein the atomizer is coupled to a wall of the secondary reservoir, and wherein the atomizer is configured to be at least partially submerged in the second volume of water.

13. The bathing system of claim 11, wherein the atomizer is configured to float within the secondary reservoir, and wherein the atomizer is configured to be at least partially submerged in the second volume of water.

14. The bathing system of claim 11, further comprising a first heater disposed in the secondary reservoir, wherein the first heater is configured to heat the second volume of water.

15. The bathing system of claim 11, further comprising a second heater configured to heat the air-water mixture upstream of the primary reservoir.

16. The bathing system of claim 11, wherein the secondary reservoir includes a pitched lower surface configured to facilitate draining of fluid from the secondary reservoir.

17. The bathing system of claim 11, further comprising a controller operatively coupled to at least one of the atomizer or the air blower.

18. The bathing system of claim 17, further comprising a water level sensor disposed in the secondary reservoir, wherein the water level sensor is configured to detect a water level in the secondary reservoir and to send a corresponding electronic signal to the controller to purge the secondary reservoir of fluid.

19. A method of controlling the water temperature of a bathing system, the method comprising:

providing a flow of air to a fluid conduit, wherein the fluid conduit is in fluid communication with a primary reservoir including a first volume of water and a secondary reservoir including a second volume of water;

introducing water from the second volume of water into the flow of air by atomizing at least a portion of the second volume of water to form an air-water mixture;

directing the air-water mixture to the primary reservoir to create bubbles in the first volume of water;

receiving, by a controller, an electronic signal indicative of a water level of the secondary reservoir; and purging, in response to the electronic signal, the secondary reservoir of fluid.

20. The method of claim 19, further comprising heating at least one of the air-water mixture or the second volume of water prior to directing the air-water mixture to the primary reservoir.

* * * * *